US006035702A

United States Patent [19]

Graham

[11] Patent Number: 6,035,702

[45] Date of Patent: Mar. 14, 2000

[54] DRAIN PLUG SENSOR FOR WATERCRAFT

[76] Inventor: John C. Graham, 325 S. 200 East #4, Salt Lake City, Utah 84770

[21] Appl. No.: 09/116,420

[22] Filed: Jul. 15, 1998

[51] Int. Cl.[7] ..... G01M 3/04

[52] U.S. Cl. ..... 73/49.8; 73/865.9

[58] Field of Search ..... 73/40, 46, 49.2, 73/49.3, 49.8, 865.9

[56] References Cited

U.S. PATENT DOCUMENTS

| | | | |
|---|---|---|---|
| 3,869,391 | 3/1975 | Kramer | 210/222 |
| 4,409,694 | 10/1983 | Barrett, Sr. et al. | 4/545 |
| 4,937,559 | 6/1990 | Meacham et al. | 340/618 |
| 5,162,793 | 11/1992 | Plost et al. | 340/984 |

*Primary Examiner*—Max Noori
*Attorney, Agent, or Firm*—Kirton & McConkie; Michael F. Krieger

[57] ABSTRACT

A drain plug sensor for determining whether a drain plug is inserted into a drain hole of a watercraft is provided. In a preferred embodiment, a reed switch for sensing a magnetic field is threadably mated with a receiver at one end thereof. The receiver and reed switch are emplaced into the drain hole. The drain plug, which is capable of being inserted into another end of the receiver, is formed together with a samarium cobalt magnet such that a magnetic field is created and emanated therefrom. In this manner, whenever the drain plug is inserted into the receiver, the reed switch detects the presence of the magnetic field. Conversely, whenever the drain plug is not inserted into the drain hole, no magnetic field is detected. Regardless of whether the drain plug is inserted into the drain hole, an indication is supplied to a user to alert the user as to whether the drain hole is operational.

7 Claims, 1 Drawing Sheet

DRAIN PLUG SENSOR FOR WATERCRAFT

BACKGROUND OF THE INVENTION

1. The Field of the Invention

The present invention relates generally to watercraft such as motor boats, fishing boats, row boats, sailing boats, canoes, jet skis, etc. More specifically the present invention relates to determining whether a drain hole of the watercraft has a drain plug inserted therein.

2. The Relevant Technology

As is known, many varieties of watercraft are equipped with a drain hole at a low point of the watercraft to facilitate the drainage of excessive water accumulated during, use of the watercraft. In general, a user removes a drain plug from the drain hole, typically by unscrewing, and any excessive water is gravity drained from the watercraft. The drain plug is usually removed for extended periods of time so that the water can drain completely and so that various surfaces of the watercraft can dry out.

Frequently, however, the unscrewed drain plug is forgotten and the watercraft is deployed into a body of water without the drain plug ever having been re-inserted back into the drain hole. As a result, watercraft become vulnerable to sinking which potentially comes at the unnecessary expense of life and/or economic waste. To a less profound extent, watercraft having no drain plug are also subject to electrical malfunctions because onrushing water potentially serves to flood electrical wiring, components and battery compartments.

To this end, some prior art devices have been employed to indicate to a user whether or not the drain hole has a drain plug inserted therein. For example, one device utilizes a plunger, fastened by a bracket above the drain hole, to indicate whether the drain plug is depressing against the plunger or not. If the drain plug is depressing against the plunger, the indication is that the drain plug is inserted therein. Whereas, if the drain plug is not depressing against the plunger, the indication is the absence of the drain plug.

Problematically, however, this device cannot determine whether the drain plug is fully seated within the drain hole.

Another device uses an external box having a chain of predetermined length attached to the drain plug. With this device, when the chain is fully extended an indication circuit is completed and the user is alerted.

Disadvantageously, both of these devices are impractical because their components are bulky and implementation is not easily and readily adapted to existing drain holes and drain plugs. This results in excessive labor expense for both manufacture and implementation and, in turn, user expense.

Still other prior art devices use connection tethers, such as beaded chains, that allow the drain plug to dangle closely to the drain hole while the watercraft is draining excessive water. Yet, drain plugs on connection tethers can also be forgotten to be re-inserted before the watercraft is deployed and tethers provide no means to indicate to users that the drain plug is not properly positioned.

Accordingly, it would be an advance to provide a sensor for determining whether a drain hole is operational, i.e., for determining whether a drain plug is inserted therein, while overcoming the foregoing problems.

OBJECTS AND SUMMARY OF THE INVENTION

It is, therefore, an object of the present invention to provide a drain plug sensor for determining whether a drain hole of a watercraft is operational.

It is another object of the present invention to provide a drain plug sensor that is adaptable to existing drain plugs and drain holes.

It is still another object of the present invention to provide a drain plug sensor having means to indicate to a user whether the drain hole is operational before deploying the watercraft.

It is yet another object of the present invention to provide a drain plug sensor having means of indicating a fully seated drain plug within the drain hole.

It is a concomitant object of the present invention to provide a drain plug sensor that is economical and requires minimal labor to implement.

In accordance with the invention as embodied and broadly described herein, the foregoing and other objectives are achieved by providing a drain plug sensor for determining whether a drain plug is inserted into a drain hole of a watercraft.

In a preferred embodiment, a reed switch for sensing a magnetic field is threadably mated with a receiver at one end thereof. The receiver and reed switch are emplaced into the drain hole. The drain plug, which is capable of being inserted into another end of the receiver, is formed together with a samarium cobalt magnet such that a magnetic field is created and emanated therefrom. In this manner, whenever the drain plug is inserted into the receiver the reed switch detects the presence of the magnetic field. Conversely, whenever the drain plug is not inserted into the drain hole, no magnetic field is detected.

Regardless of whether the drain plug is inserted into the drain hole, an indication is supplied to a user to alert the user as to whether the drain hole is operational.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawing. Understanding that this drawing depicts only typical embodiments of the invention it is not therefore to be considered to be limiting of its scope, the invention in its presently understood best mode for making and using the same will be described and explained with additional specificity and detail through the use of the accompanying drawing in which:

the sole FIGURE is an exploded view of a drain plug sensor in accordance with the present invention.

DETAILED DESCRIPTION OF THE PREFERRED EMBODIMENTS

Figure 1:
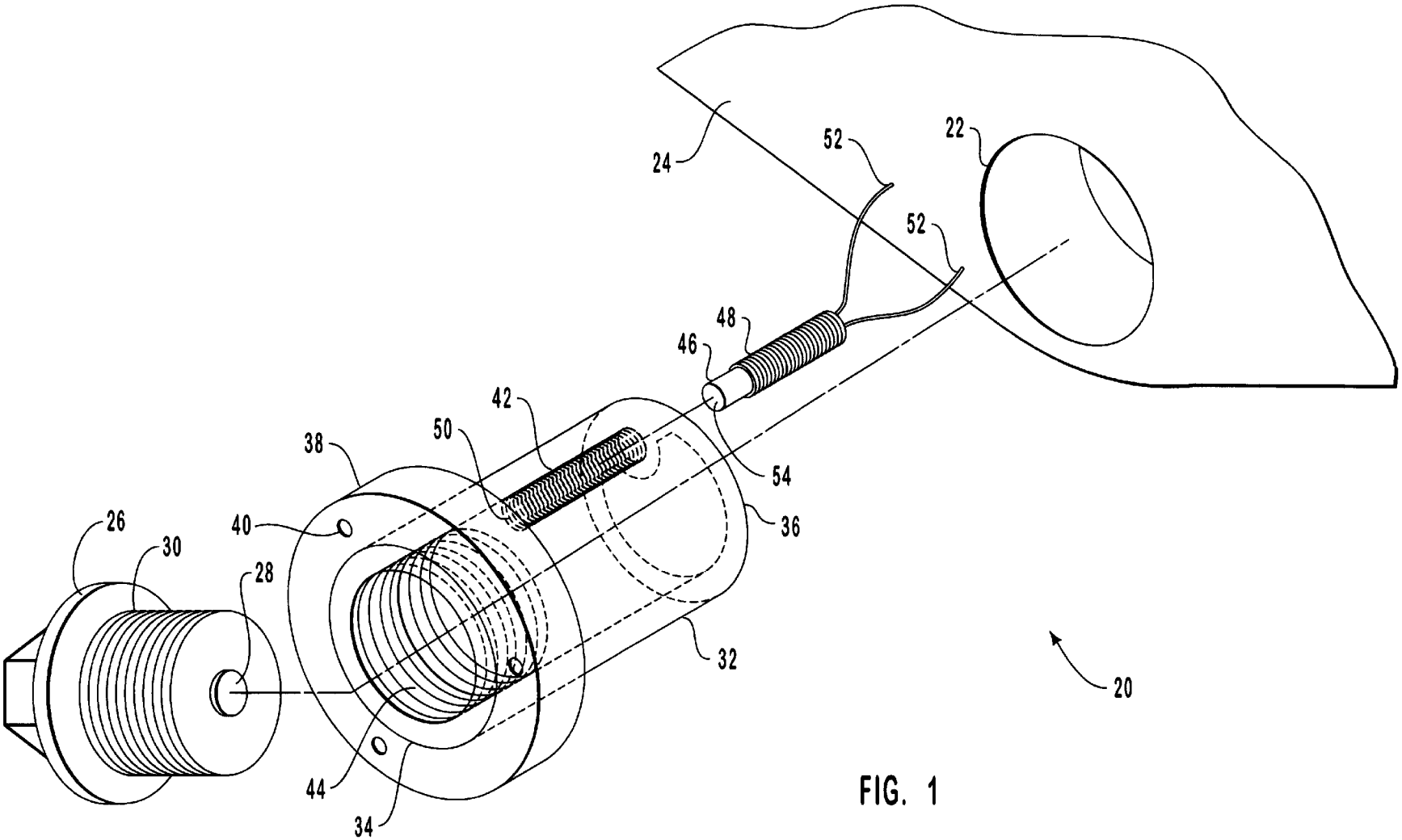

The present invention relates to determining whether a drain hole of a watercraft is operational, i.e., whether the drain hole is open or closed with a drain plug inserted therein. It is a feature of the present invention that such may be readily and economically determined with easy adaptation to existing drain plugs and drain holes.

With reference to FIG. 1, a drain plug sensor in accordance with the present invention is depicted generally as 20. In a preferred embodiment, the drain plug sensor 20 generally comprises: (i) a drain plug 26 for ultimately inserting into a drain hole 22 of a watercraft to prevent water from accumulating in the watercraft during use; (ii) a means for detecting 46 whether the drain plug 26 is inserted into the drain hole 22; and (iii) a receiver 32 providing connection between the means for detecting 46 and the drain plug 26.

In this embodiment, the drain plug 26 is formed with a means for creating a magnetic field. Some preferred means include, but are not limited to, forming the drain plug out of metal or by forming a magnet 28 therewith.

If the magnet 28 is formed with the drain plug 26 some preferred methods include: hollowing out an appropriately sized portion of the drain plug and inserting or pressing the magnet therein (to facilitate the placement of the magnet 28 an epoxy or adhering substance may additionally be added); applying an adhering substance to both the magnet and drain plug and pressing together; and mechanically fastening the magnet to the drain plug with fasteners such as clamps, screws, bolts, etc.

The preferred magnet 28 is a samarium cobalt magnet because of its inherent properties which are conducive in a watercraft environment. Such properties include substantial insensitivity to change in temperature, imperviousness to both salt and fresh water, ability to withstand heavy vibrations and ability to remain magnetically unaltered in the presence of other magnetic fields caused or emanated from the watercraft. Some other magnets known to have such properties include, but are not limited to, various other rare earth magnets.

It will be appreciated, however, that the magnet can still be embodied in other forms such as ceramics, iron-ferrite, combinations of the foregoing or any other known magnets able to create a magnetic field.

The receiver 32 is shaped generally like a cylinder fitted with a flange 38 and has a first 34 and second end 36 thereof for respectively mating with the drain plug 26 and the means for detecting 46 the drain plug during use. Preferred mating means include, at the first end 34 along an interior of the receiver 32, a first set of threads 44 for threadably mating with a second set of threads 30 along the drain plug 26. Other mating means include tapered fittings, tongue-and-groove arrangements, interlocking pieces, etc.

At the second end 36, substantially within the interior of the receiver 32, is a reception unit 42 for mating with the means for detecting 46 the drain plug. Preferably, the reception unit 42 and the means 46 are threadably mated by threading a third set of threads 50 within the reception unit together with a fourth set of threads 48 along a portion of the means for detecting 46.

In this embodiment, the preferred means for detecting 46 includes a reed switch in the form of a cylinder. As is known, reed switches can be configured with internal contacts that open or close in the presence of a magnetic field and can be electrically connected to various electrical circuit arrangements. Further properties of reed switches are not discussed herein in detail.

During use, the reed switch is threadably mated within the reception unit 42 of the receiver 32 and the receiver 32 is inserted into the drain hole 22 of the watercraft until the flange 38 of the receiver 32 abuts against a surface 24 of the watercraft which is often the actual hull of the watercraft. Then, to maintain the drain plug sensor 20 in a substantially stationary manner, openings 40 are provided in the flange 38 to allow mechanical fasteners such as screws and/or bolts, etc., to pass therethrough and secure the flange of the receiver 32 against the surface 24. It will be appreciated, however, that to accommodate the various locations of drain holes of various watercraft, the flange may be alternatively shaped and arranged.

Once secured, the drain plug sensor 20 determines whether the drain hole 22 is operational by utilizing the magnetic field sensing properties of the reed switch to determine if a magnetic field is present within the first end of the receiver. If a magnetic field is present, this indicates that the drain plug 26 is mated with the first end 34 of the receiver 32. If no magnetic field is present, this indicates that the drain plug is not inserted within the first end of the receiver.

It will be appreciated that depending upon the combination of the strength of the magnetic field created by the drain plug, the proximate positioning of the reed switch threadably mated within the reception unit and the sensitivity of the reed switch for sensing a magnetic field, it can readily be determined whether or not the drain plug is fully inserted within the first end as opposed to being partially inserted therein.

Then, depending upon how configured, the means for detecting 46 indicates to a user whether the drain plug is inserted into the drain hole by completing or opening an appropriate circuit. Preferably, this indication is accomplished by connecting, in means well known in the art, an indicator (not shown) such as a lamp, LED, buzzer, audio-alarm, visual-alarm, audio-visual alarm, combinations thereof, etc., to electrical leads 52 extending from means 46. In this manner a user is alerted to whether the drain plug 26 is in the drain hole 22. It is even within the scope of this invention that the electrical leads 52 can be connected to an ignition prevention circuit which would disable the starting of a motor of the watercraft.

This invention advances the state of the art for numerous reasons. Some of those reasons include, but are not limited to: (i) the ability to determine not only whether the drain plug is inserted into the drain hole but the ability to determine if the drain plug is partially or fully inserted; (ii) the ready adaptation of existing drain plugs; (iii) the economic feasibility thereof; and (iv) the ease of implementation.

Alternatively, it will be appreciated that the foregoing may be implemented using various other equivalent structures and be within the intended scope of the inventions. For example, it is contemplated that the drain plug 26 and the reed switch may be arranged directly within the drain hole 22 without necessitating the receiver 32 to act as an intermediary housing.

The reed switch may alternatively be replaced with other mechanisms by which a magnetic field may be detected such as another magnet arranged with or without a particular pole arrangement or a torque-coil.

Although not shown, along portion 54 of the means for detecting 46 could be emplaced a contact-switch for completing a circuit, via electrical leads 52, whenever the drain plug physically contacts the contact-switch.

The means for detecting 46 could also be a proximity sensor that detects the presence of the drain plug 26 whenever the drain plug reaches a predetermined distance from the sensor.

Exemplary materials for the receiver portion of the drain plug sensor 20 include, but are not limited to, metals, plastics, polymers, combinations thereof or any other material allowing for the detection of the drain plug therein.

The present invention may be embodied in other specific forms without departing from its spirit or essential characteristics. Thus, the described embodiments are to be considered in all respects as illustrative only and not restrictive. The particular scope of the invention is indicated by the appended claims rather than by the foregoing description. All changes which come within the meaning and range of equivalency of the claims are to be embraced within their scope.

What is claimed is:

1. An apparatus for alerting a watercraft user as to whether a watercraft drain is open or closed, comprising:

a receiver for mounting in a drain hole in a hull of a watercraft;

an aperture passing through said receiver, said aperture allowing passage of liquids through said receiver;

a drain plug configured to be received into said aperture so as to be secured therein and prevent passage of liquids therethrough, said drain plug having a magnetic field;

a sensor for sensing a magnetic field, said sensor being mounted integral to said receiver and internal to the hull of the watercraft such that no wiring or circuitry is external to said hull; and an alarm electrically connected to said sensor for indicating when said drain plug is secured in said aperture.

2. The apparatus of claim 1 wherein said sensor is a single magnetically actuated switch.

3. The apparatus of claim 1 wherein said apparatus is fully functional while the watercraft is in any position either out of the water or floating on the water.

4. An alarm system for alerting a watercraft user as to whether a watercraft drain is open or closed, said system comprising:

an aperture passing through a watercraft hull, said aperture allowing passage of liquids through said hull;

a drain plug configured to be received into said aperture so as to be secured therein and prevent passage of liquids therethrough, said drain plug having a sensor actuator;

a position-independent and launch-condition independent sensor for sensing a sensor actuator, said sensor being mounted internal to said hull such that all wiring and circuitry is internal to said hull; and an alarm electrically connected to said sensor for indicating when said drain plug is secured in said aperture.

5. The apparatus of claim 4 wherein said sensor senses a magnetic field and said sensor actuator is a magnet.

6. The apparatus of claim 4 wherein said sensor senses the proximity of a drain plug.

7. The apparatus of claim 4 wherein said sensor is a physically actuated switch which is actuated by securing said plug in said aperture.

* * * * *